United States Patent [19]

Parker

[11] Patent Number: 4,536,903

[45] Date of Patent: Aug. 27, 1985

[54] DEVICE FOR MANIPULATING INVALID BED PATIENTS

[76] Inventor: Leslie L. Parker, 4196 44th St., San Diego, Calif. 92105

[21] Appl. No.: 510,340

[22] Filed: Jul. 1, 1983

[51] Int. Cl.[3] ..... A61G 7/10

[52] U.S. Cl. ..... 5/61; 5/81 R; 128/134

[58] Field of Search ..... 5/508, 81 R, 81 C, 61, 5/424, 123; 128/134, 133

[56] References Cited

U.S. PATENT DOCUMENTS

| | | | |
|---|---|---|---|
| 725,475 | 4/1903 | Palmer | 5/123 |
| 803,091 | 10/1905 | Brayshaw | 5/123 |
| 1,334,901 | 3/1920 | Higdon | 5/61 |
| 3,236,234 | 2/1966 | Buckley | 128/134 |
| 3,535,719 | 10/1970 | Murcott | 5/424 |
| 3,884,225 | 5/1975 | Witter | 5/431 |
| 4,180,879 | 1/1980 | Mann | 128/134 |

FOREIGN PATENT DOCUMENTS

| | | | |
|---|---|---|---|
| 849375 | 8/1970 | Canada | 128/134 |

*Primary Examiner*—Alexander Grosz

*Attorney, Agent, or Firm*—Gary, Juettner & Pyle

[57] ABSTRACT

A device for conveniently, gently and comfortably manipulating bed patients into various positions of rest, to aid in the prevention and/or treatment of pneumonia and to aid in the prevention and cure of bed sores in long term bed ridden patients, comprises a sheet of porous, "breathable" fabric of a size to span the width of the bed and to underlie the torso of the patient, hand grip means at the ends of the sheet adjacent the sides of the bed facilitating movement of the sheet into partially encircling relation to the patient's torso and rolling of the patient's body between the supine position (flat on the back) and positions on either of the patient's sides, at any desired degree of roll, and means for fastening the hand grip means to the bed for holding the patient's body at the desired degree of roll, thereby to mitigate accumulation of fluids in the patient's lungs and minimize the potential for pneumonia, to expose the patient's back to the air to mitigate the occurrence of bed sores, and to contribute to the patient's overall comfort and well being. Moreover, the device accommodates manipulation of the patient by one person without assistance, thereby to facilitate good care of the patient at home without professional aid, as well as in hospitals and professional nursing facilities.

5 Claims, 7 Drawing Figures

DEVICE FOR MANIPULATING INVALID BED PATIENTS

BACKGROUND OF THE INVENTION

Persons who are bed-ridden for long periods of time, especially the elderly, run serious risks of pneumonia and other diseases due to inactivity and lying in a supine position (flat on the back) for prolonged intervals. Nursing staffs attempt to alleviate these problems by requiring patients to lie on their sides at least a portion of the time. However, many patients are too weak to roll over themselves and/or to maintain a position of rest on their sides. Nurses must therefore manually roll the patient from the supine position to a side position and wedge pillows behind the patient's back in order to prop the patient up in the desired side supported position. This generally requires the services of at least two nurses or attendants, and even then is rarely fully effective. Moreover, the practice is discomforting for the patient and fails entirely to achieve one objective of resting on the side, i.e., ventilation of the patient's back. Because of this lack of ventilation, many such patients develop bed sores which are literally impossible to cure or heal because the source or cause thereof is never alleviated.

Moreover, the frequency of requisite movement and the need for two or more nurses or attendants to adjust the patient's position relegates many patients to institutional care rather than home care, even though their condition might otherwise be such that the loving care of family in familial surroundings would be economically and psychologically preferable for all concerned.

BRIEF SUMMARY OF THE INVENTION

The object of the invention is to provide a device which will permit one person, even an unskilled person, to very conveniently, gently and comfortably roll an invalid or bed-ridden patient from the supine position onto either side, at any desired degree of roll, and to comfortably support the patient on his or her side in an adjusted position wherein the patient's back is exposed for ventilation.

In its preferred embodiment, the device comprises a sheet of porous fabric including a central portion of a size to underlie the torso of the patient, from the shoulders to the buttocks, and opposite end portions extending laterally outward from the central portion at an elevation below the patient's arm pits, so that the fabric can partially encircle the patient's torso while leaving the arms and legs free for movement; hand grip means extending laterally outward from each end portion, each hand grip means being adapted to be individually pulled over the patient's torso to cause the fabric sheet to partially encircle the patient's torso and cause the patient's body to be rolled, gently and comfortably, over onto his or her side; and quick-connect/quick-disconnect fastening means for securing the hand grip means to the opposite side of the bed to comfortably support the patient's body at any desired degree of roll, e.g., $\frac{1}{4}$, $\frac{1}{2}$ or $\frac{3}{4}$ roll.

In any of such rolled positions, the patient is comfortably supported with a hammock type of support around the back and side portions of the torso only, with the arms and legs free for movement, and with the patient's back removed from the surface of the bed for free ventilation through the porous fabric.

The device is extremely easy to use and only one person is required to roll the patient, even a patient of substantial weight, to a comfortable position on his or her side. Likewise, it is extremely easy for this one person to gently return the patient to a supine position or to roll the patient onto his or her other side.

Thus, even a seriously weak or invalided patient can be conveniently, comfortably and gently rolled to various positions of comfortable rest in the bed to prevent or aid in the treatment of pneumonia and other diseases, and to prevent or cure bed sores, resulting from prolonged inactivity and excessive confinement to a supine position. Moreover, since only one person is needed to manipulate or adjust the position of the patient, the patient may in many cases be cared for at home without the expense and the sometimes psychologically depressing accommodations of a formal institution.

The foregoing and other objects and advantages of the invention will become apparent from the following detailed description, considered in conjunction with the accompanying drawings.

DETAILED DESCRIPTION

Figure 3:
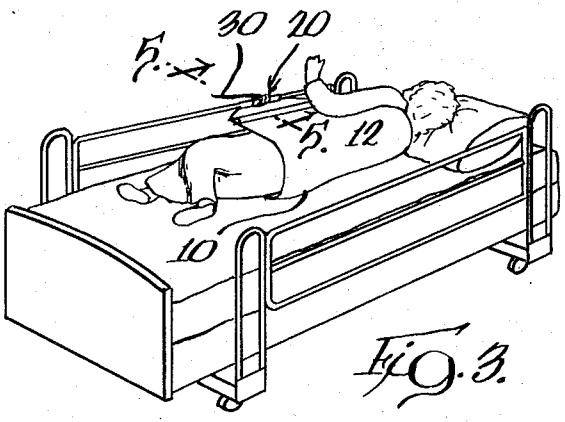
FIG. 3 is a schematic illustration similar to FIG. 2 showing the patient rolled onto her side and held in such position by the device of the invention.
Figure 2:
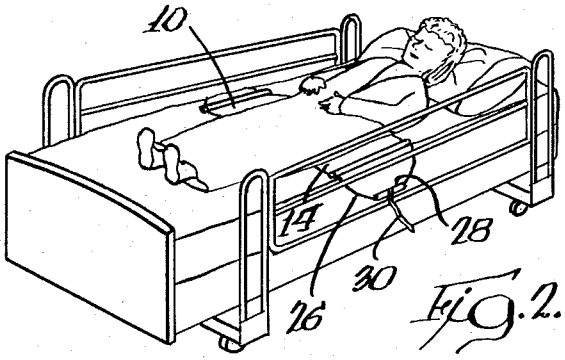
FIG. 2 is a schematic illustration of a patient in a supine position on a bed with the device of the invention in place for use.
Figure 1:
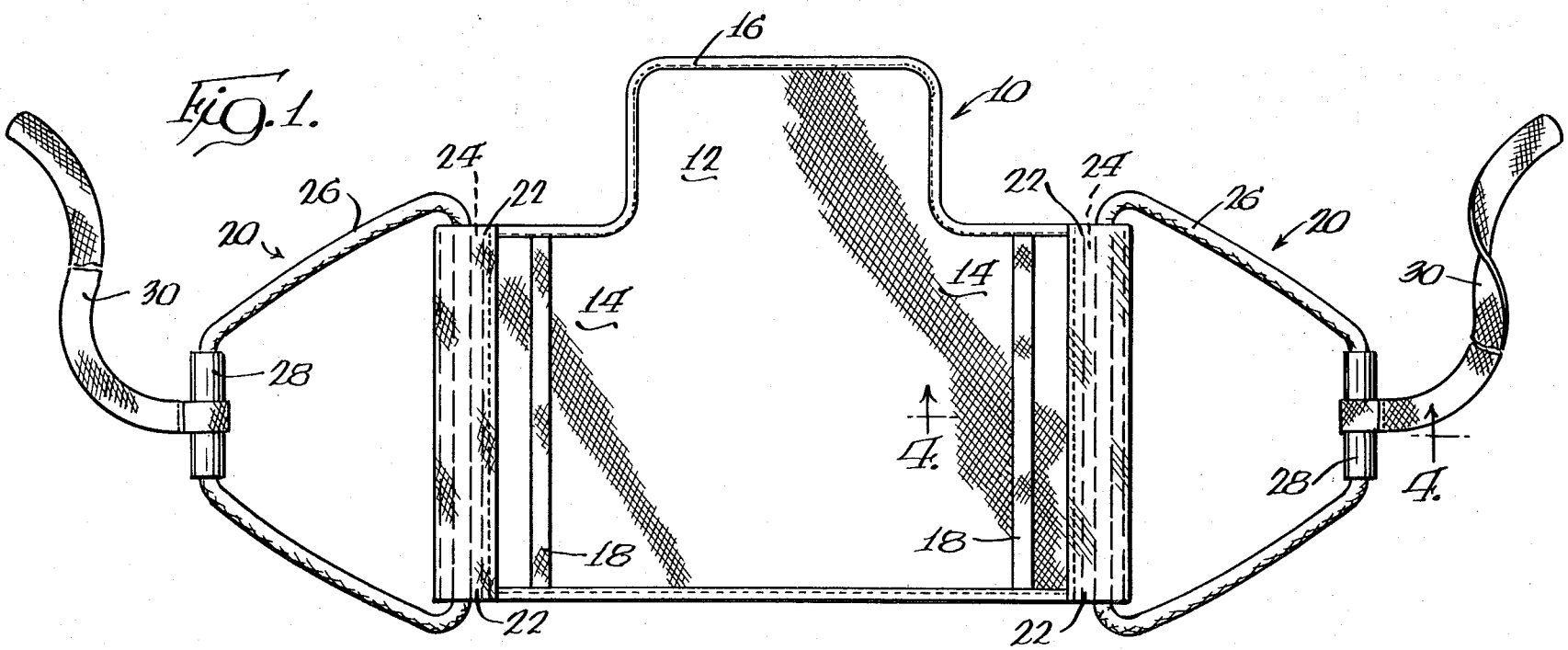
FIG. 1 is a plan view of the preferred embodiment of the device of the invention.

Referring to FIGS. 1 to 3, the device of the invention comprises a sheet 10 of porous fabric having a central portion or panel 12 of a width and length to underlie a supine patient's torso from the shoulders to a location slightly below the buttocks, and complementary end portions or panels 14 extending laterally outward from the opposite sides of the central portion with their upper edges spaced below the upper edge of the central panel so as to extend outwardly from an elevation below the patient's arm pits. The size of the sheet 10 and its central and end portions can be varied to match the size of the patient and can, for example, be furnished in various sizes such as large, medium, small, child and infant. In a preferred embodiment intended for use with adults of average size, the central portion or panel is 20 inches wide and 34 inches long, and each end portion or panel is 12 inches wide and 24 inches long with its upper edge spaced 10 inches downwardly from the upper edge of the central panel and its lower edge contiguous with the lower edge of the central panel.

The sheet 10 is preferably a single, integral sheet of fabric without seams, but the same could also be fabricated from three or more individual panels seamed together if desired. The material for the sheet may be selected from any of a variety of sheet fabrics which have combined characteristics of adequate strength, reasonable porosity or breathability, fire and stain resistance, and washability. The preferred fabric is parachute silk which possesses all of these characteristics to an admirable degree.

Figure 5:
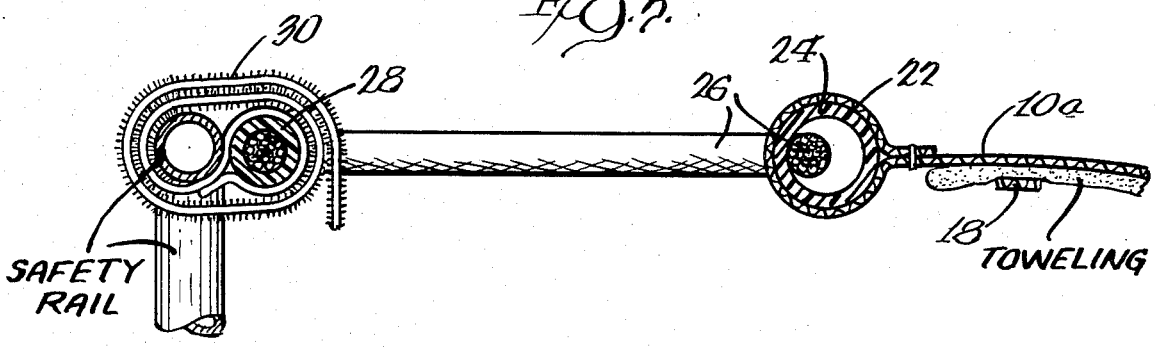
FIG. 5 is a cross-sectional view of the same end portion of the device as illustrated in FIG. 4, but showing the same as secured to the safety rail of the bed for holding the patient on her side in the position illustrated in FIG. 3; the view being taken substantially on line 5—5 of FIG. 3.

To ensure the patient's comfort and to avoid gouging or chafing of the skin, the top and bottom edges of the fabric sheet are provided with rolled or cushioned hems 16. In addition, to aid in the patient's comfort and/or to alleviate potential problems arising from perspiration, incontinency or the like, toweling or other cushioned and/or absorbent material may be laid over the fabric sheet 10 and be held in place thereon by a pair of bands or straps 18 mounted on the end panels of the fabric sheet parallel to their respective end edges. The bands 18 are suitably secured at their ends to the end panels by the hems 16 for reception thereunder of the absorbent material (see FIG. 5) for retaining the material in proper relation to the sheet irrespective of the body movements of the patient.

Figure 4:
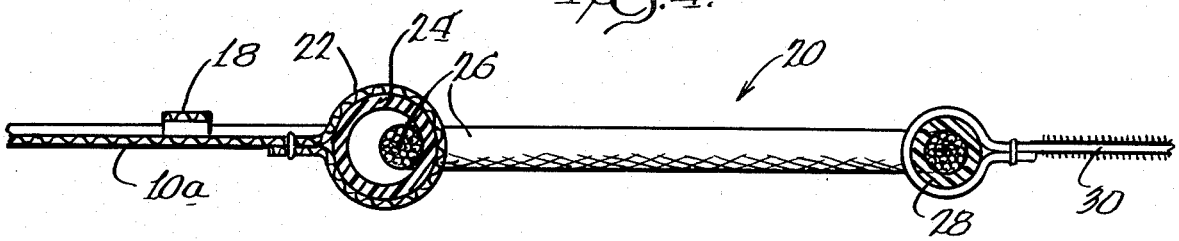
FIG. 4 is a cross-sectional view, on an enlarged scale, taken substantially on line 4—4 of FIG. 3, of one end portion of the device of the invention illustrating the preferred form of hand grip means for the device.

At the laterally outer edge thereof, each end panel 14 is provided with hand grip means 20 for manipulating the fabric sheet and the patient lying thereon. In the preferred embodiment of the hand grip means, as shown in FIGS. 1 and 4, the outer edge of each end panel is turned or rolled on itself and hemmed, in a relatively wide hem 22, thereby to define a tubular socket for reception of a rigid tube 24 of a length approximately equal to the length dimension of the end panel. The tube is preferably formed of stainless steel or a readily sanitized plastic to ensure compatibility with hospital standards. Extended through the tube 24 is a bail 26 which extends outwardly from the end panel a distance sufficient for manipulation of the patient in the manner to be described. In a device dimensioned as above set forth, a suitable lateral extension for the hand grip is about 14 inches. At the outer end thereof, the bail is closed upon itself and provided with a handle 28. While various materials may be used to form the bail 26, a preferred material is flexible rope, such as a nylon rope.

Associated with the handle 28, or with some other suitable part of the hand grip means, is a quick-connect-/quick-disconnect fastening means, which in the preferred embodiment comprises a strap 30 of material sold under the trademark "Velcro" which has the capability of strongly adhering to itself when plies of the material are pressed together.

In use of the device of the invention, the fabric sheet 10 is placed on the patient's bed in a location (usually the center of the bed) where the patient would normally lie in a supine position, and at such elevation that the central portion 12 extends from approximately the shoulders to just below the buttocks of the patient's torso, and with the two end panels 13 and hand grip means 20 extending laterally outward toward the respective sides of the bed. This disposition of the device, with the patient in a supine position thereon, is illustrated in FIG. 2. In the supine position, the patient is perfectly comfortable and at ease and the device poses no obstacle to restful comfort.

When it is desired to roll the patient onto her side, e.g., here right side, the left hand panel (as viewed by the patient) and hand grip means are placed on top of the patient and the attendant positions herself at the right side of the bed. Grasping the left-handle 28, the attendant simply pulls the handle toward her, and the patient is automatically rolled onto her side. The patient's own weight retains the fabric in the location in which it was placed on the bed, and the pulling on the handle very gently, conveniently and comfortably rolls the patient onto her side. When the patient is at the desired degree of roll, e.g., $\frac{1}{4}$, $\frac{1}{2}$ or $\frac{3}{4}$ roll, the "Velcro" fastener strap 30 is simply wrapped around the most convenient rung on the bed's safety side rail and pressed together (see FIG. 5), whereupon the patient is effectively yet comfortably held, in a hammock-like effect, in the desired position. The patient's left arm may be removed from confinement by the fabric sheet either before or after the roll, due to the cut away effect provided by the left-hand end panel. Also, the patient's legs may be moved to a comfortable position since they are not in any way confined by the fabric sheet 10. Thus, the patient can be rolled to a comfortable position of rest on her side as illustrated in FIG. 3. The entire manipulation is extremely fast, easy and effective, and can readily be done by one person.

In a side position of rest, the patient's back is removed from its supine position on the bed, and the fabric 10, being porous, permits ventilation or "breathing" of the patient's back whereby to prevent or aid in the cure of bed sores. The patient is very comfortably supported, with freedom of movement for her legs and at least her exposed (left) arm, whereby to prevent or to aid in the treatment of pneumonia and other diseases that might arise from prolonged inactivity and/or confinement to a supine position. The device completely eliminates all of the discomfort, draw backs and labor intensiveness of the existing practice of wedging pillows under the patient's back.

To return the patient to a supine position, it is only necessary to grasp the handle 28, release the fastening means 30 and gradually move the handle toward the left side of the bed, whereupon the patient rolls gently back into the supine position. To prop the patient up on her left side, it is only necessary to repeat the above described procedure using the right-hand hand grip, handle and fastening means. Manipulation of the bed-ridden patient is thus simplicity itself. Even an untrained person working with or assisting an extremely brittle or pain filled patient can gently and comfortably roll the patient to positions of greater restfulness.

Figure 6:
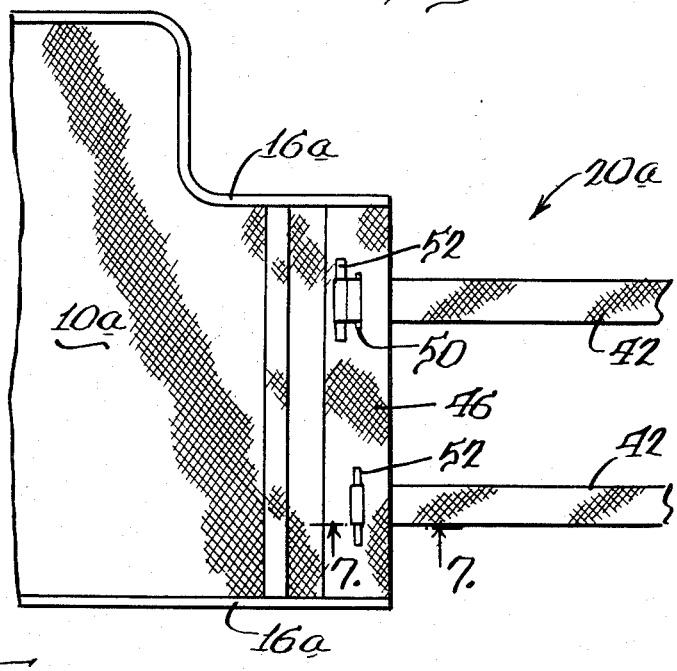
FIG. 6 is a plan view of one end portion of a second embodiment of the device showing a modified form of hand grip means for the device.
Figure 7:
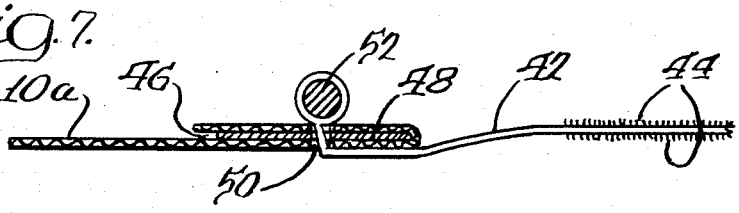
FIG. 7 is a cross-sectional view, on an enlarged scale, taken substantially on line 7—7 of FIG. 6, further illustrating the modified form of hand grip means.

Turning now to FIGS. 6 and 7, a modified form of hand grip means **20*a*, for manipulating a fabric sheet 10*a* and a patient thereon in substantially the same manner as above described, is shown as comprising one or more straps 42** secured to the end edges of the sheet and extending laterally outward therefrom; the straps including opposite surfaces of "Velcro" fastener material throughout their length, or over the outer end portions thereof, thereby to define means for fastening the straps to the bed hand rail to support a patient on his or her side in essentially the manner above described. The use of two straps is somewhat inconvenient inasmuch as it requires two handed manipulation, as contrasted to the one hand operation provided by the preferred embodiment and/or by a single strap with or without a handle. On the other hand, the use of two straps provides the advantage, at least for some patients and their attendants, of permitting differential adjustment of the degree of roll of the upper and lower parts of the patient's torso.

The strap or straps 42 can, if desired, be secured directly to the end portions of the end panels, for example, by sturdy stitching. However, in FIGS. 6 and 7, a detachable mounting is provided which (a) permits the use of a single set of straps alternately on both sides of the bed, rather than requiring two sets of straps, and (b) permits detachment of the straps when not in use so they need not hang from the sides of the bed, thereby to improve appearances and facilitate makeup of the bed linens. As shown, the end edge of each end panel is folded over on itself and stitched into the upper and lower edge hems 16*a* on the sheet 10*a* so as to define a laterally inwardly open pocket 46 for removable reception of a sheet of reinforcing material 48, such as a stainless steel or rigid plastic plate. Both plies of the folded end edge portion of the fabric and the plate 48 are provided with aligned slots 50 of a width greater than that of the straps and comprising key lock slots for detachable reception of the straps. Each strap 42 is provided at its end with a key lock comprising a rigid crossbar 52 of a length greater than the width of the slot 50, so that each strap can be fed and pulled through the slot to bring the crossbar into firm but reversely detachable engagement with the reinforced end edge portions of the sheet 10*a*, as provided by the rigid plate 48.

The mode of use of the device of FIGS. 6 and 7 is in essence the same as above described in connection with FIGS. 1, 2 and 3. With either form of the device, manipulation of a bed-ridden patient between a supine position and positions of rest on either of the patient's sides is achieved with utmost simplicity and ease. Even an untrained person working with or attending an extremely brittle or pain filled patient can gently and comfortably roll the patient to positions of greater restfulness. Also, the patient is not seriously confined and can move her arms and legs to engage in at least some activity to improve circulation and mitigate the occurrence of afflictions which commonly affect the bed-ridden.

In addition, the two illustrated embodiments of the device are formed of stain and fire resistant materials which are compatible with and satisfy the sanitation requirements of hospitals and other institutions. Also, the rigid components of the hand grip means are readily detachable from the fabric sheet to render the sheet machine washable.

Thus, the objects and advantages of the invention have been shown herein to be attained in a facile, economical and highly effective manner.

While two preferred embodiments of the device of the invention have been shown and described, it is apparent that various changes, rearrangements and modifications can be made therein without departing from the scope of the invention as defined by the appended claims.

What is claimed is:

1. A device for manipulating bed patients into various positions of rest comprising a flexible, pliant sheet of porous fabric of a size to underlie the torso of the patient, said sheet of fabric including a central portion of a width approximately equal to the width of the patient's torso and of a length to underlie the patient's torso from approximately the shoulders to the buttocks, and end portions extending laterally outward from said central portion at an elevation to extend outwardly below the patient's arm pits, whereby the patient's arm and legs may be free from confinement when the device is in use, hand grip means on at least one end of said sheet adjacent a respective side of the bed for moving the contiguous end portion of said sheet into partially encircling relation to the torso of the patient and for rolling the patient from a supine position into a position on one of the patient's sides, said hand grip means including a hemmed edge portion on said at least one end of said sheet defining a socket extending along substantially the full length of said end of said sheet, a renforcing member of a length approximately equal to the length of said end of said sheet removably inserted in said socket to rigidify said end of said sheet and to cause the same to move as a unitary whole despite the pliability of said sheet, and fastening means removably associated with said reinforcing member for fastening said end of said sheet to the bed for holding the respective end of said sheet to the bed in partially encircling relation to the patient's torso and for thereby holding the patient's body on its side in a selected position, said reinforcing member maintaining said sheet smooth and fully extended lengthwise throughout the length of said sheet both during a patient rolling movment and when the patient's torso is held in a selected position to insure uniform and comfortable engagement of said sheet with the patient's torso throughout the length of said sheet, said fastening means and said reinforcing member being removable from said sheet to facilitate laundering of said sheet.

2. A device as set forth in claim 1 wherein said hand grip means comprises strap means removably engaged with and extending laterally outward from said reinforcing member and of a length to extend adjacent the opposite side of the bed when the body of the patient is rolled on its side, and wherein said fastening means comprises quick-connect and quick-disconnect means on said strap means for adjustably and releasably securing said strap means to said opposite side of the bed.

3. A device as set forth in claim 2, wherein said strap means comprises at least one strap having a key lock on one end thereof, and wherein said sheet includes a hemmed portion and a removable reinforcing member at each end thereof adjacent each side of the bed, each said hemmed portion and reinforcing member including a key lock slot therein for interlocking reception of the key lock on said strap, whereby said strap may be releasably attached to either end edge of said sheet for rolling the body of the patient onto either of its sides.

4. A device as set forth in claim 1 wherein said reinforcing member comprises a tube removably inserted in said socket and said hand grip means includes a bail extending through said tube and releasably closed on itself to define a handle for pulling the end edge of said sheet about the patient's body, and wherein said fastening means comprises quick-connect and quick-disconnect means on said bail for adjustably and releasably securing said bail to the opposite side of the bed.

5. A device as set forth in claim 4 wherein said bail comprises a rope extended through said rigid tube and releasably closed on itself to define a closed loop, and said handle comprises a hand grip slidably mounted on said rope generally parallel to said rigid tube.

* * * * *